United States Patent [19]

Spence

[11] 4,414,070

[45] Nov. 8, 1983

[54] ANODE POSITIONING SYSTEM

[75] Inventor: John S. Spence, Arvida, Canada

[73] Assignee: Alcan International Limited, Montreal, Canada

[21] Appl. No.: 348,170

[22] Filed: Feb. 12, 1982

[51] Int. Cl.[3] ..... C25D 17/00

[52] U.S. Cl. ..... 204/225; 204/286; 204/297 R

[58] Field of Search ..... 204/225, 286, 297 R, 204/243 R

[56] References Cited

U.S. PATENT DOCUMENTS

| | | | |
|---|---|---|---|
| 3,219,570 | 11/1965 | Wunderli | 204/225 |
| 3,329,592 | 7/1967 | Uhrenholdt | 204/225 |
| 3,761,379 | 9/1973 | Elliott | 204/225 |
| 4,210,513 | 7/1980 | Mutschler | 204/225 |

*Primary Examiner*—John F. Niebling

*Attorney, Agent, or Firm*—Cooper, Dunham, Clark, Griffin & Moran

[57] ABSTRACT

For use with an electrolytic cell having multiple suspended anodes, an anode positioning system including an individual screw jack for raising and lowering each anode, an individual reduction gear box for driving each screw jack, an individual slipping frictional clutch connected to the input shaft of each gear box, and a motor for bidirectionally driving the gear boxes through the clutches. The motor is connected to the clutches through a transmission selectively operable to drive all the gear boxes in the same direction, or to simultaneously drive some of the gear boxes in one direction and others in the opposite direction so that some anodes are raised as others are lowered thereby to "pump" the cell by agitating the electrolyte.

12 Claims, 11 Drawing Figures

Fig. 1.
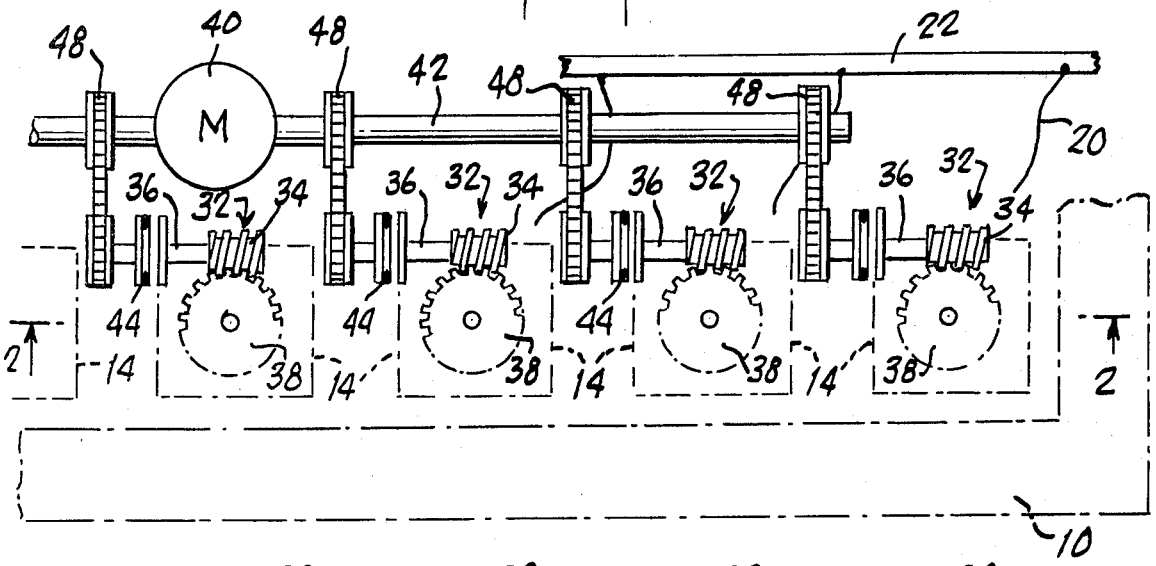
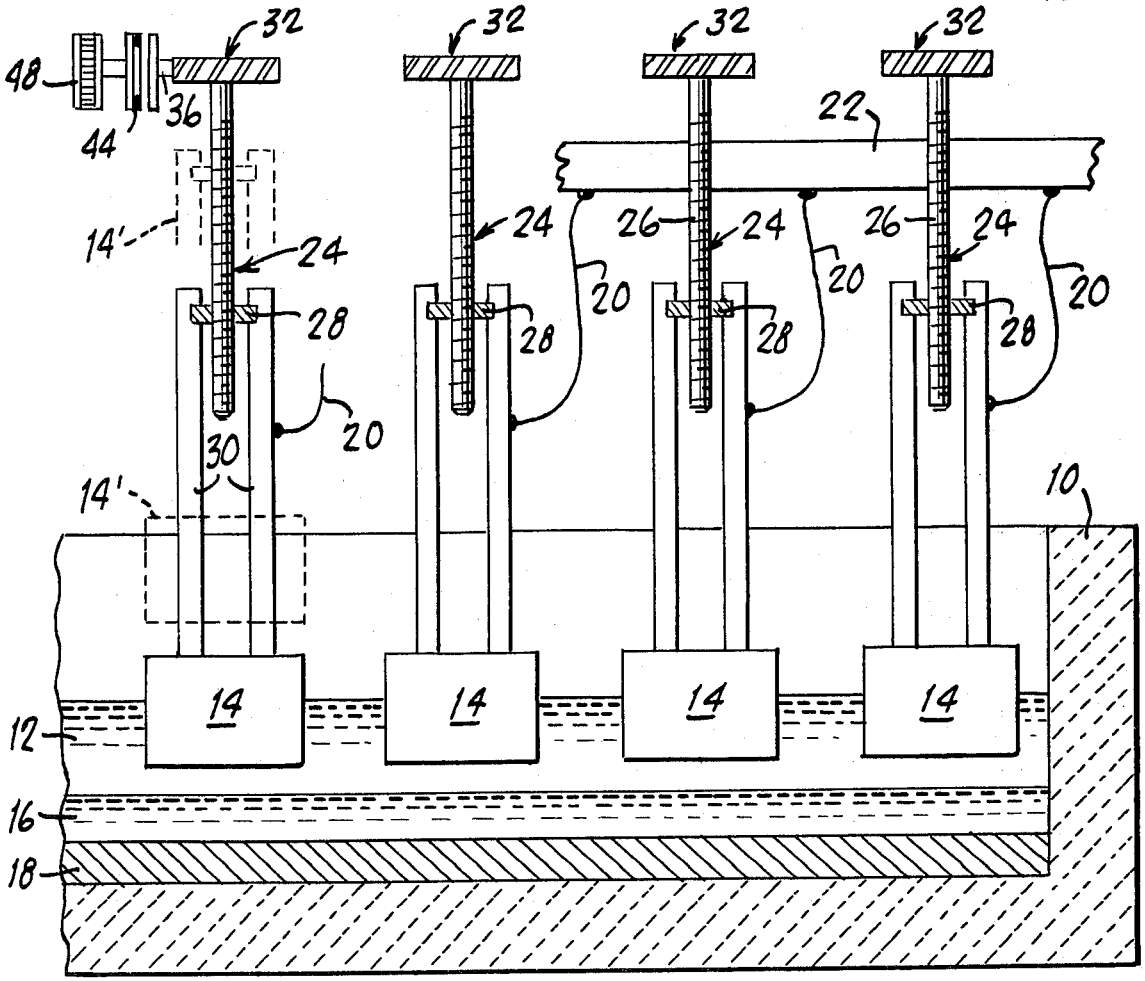
Fig. 2.

Fig. 6.
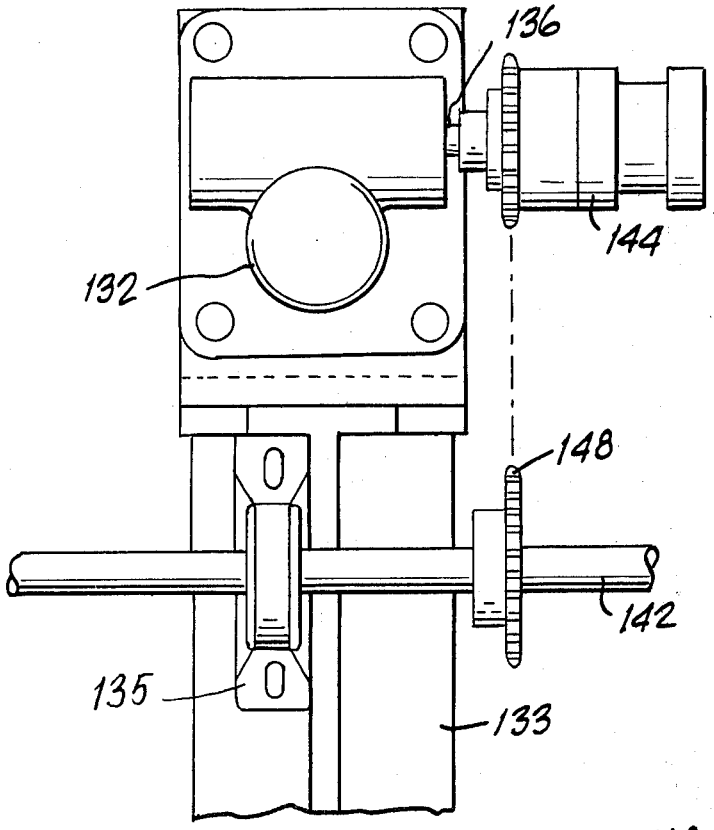
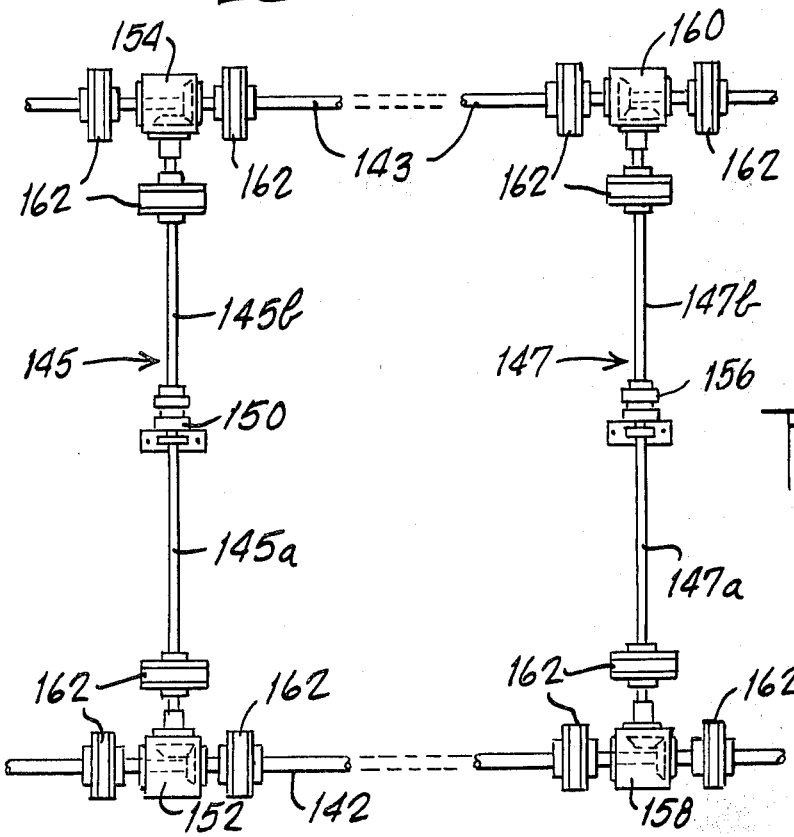
Fig. 7.

ANODE POSITIONING SYSTEM

DESCRIPTION

BACKGROUND OF THE INVENTION

This invention relates to an anode positioning system for an electrolytic cell having multiple suspended anodes, and specifically to a system for raising and lowering such anodes.

An important particular application of the invention is in the production of aluminum metal in a cell of the well-known type containing a multiplicity of prebaked, block-shaped carbon anodes individually suspended from a superstructure so as to be simultaneously in contact with the electrolyte of the cell. Alumina dissolved in the molten salt electrolyte is reduced by passage of direct current therethrough, between the anodes and a pool of the produced molten metal that collects at the bottom of the cell in contact with a carbon cell lining which is connected electrically to enable the pool to serve as the cell cathode. As cell operation proceeds, the molten metal level in the cell varies, owing to the progressive accumulation and periodic removal of product metal. Since cell efficiency is dependent on the anode-cathode distance, i.e. the vertical spacing between the anodes and the subjacent electrolyte-metal interface, it is necessary to adjust the vertical position of the anodes in correspondence with these changes in metal level. Other circumstances also require vertical movement of anodes, either collectively or individually, from time to time; for example, as the carbon anode blocks become consumed by oxygen liberated at the anodes, their remnants must eventually be raised out of the cell and replaced. In addition, agitation of the cell bath is sometimes desirable for the purpose of quenching so-called anode effects. Such agitation is commonly effected, in present-day practice, by inserting a piece of green wood into the molten electrolyte, thereby to cause gases and vapors to bubble through the electrolyte as the wood is violently consumed.

It is already known to mount each anode of a multi-anode cell on its own individual screw jack, each jack having a pneumatic or electric motor which drives the jack (to raise or lower the associated anode). A variety of problems has been encountered in the provision and operation of these devices. Not only do they require relatively complex, large and costly components, but in addition they are vulnerable to development of excessive torque from jamming or other causes, that can result in motor burnout or damage to other components. Moreover, in the operation of such devices, it is difficult to achieve desired uniformity of displacement of plural anodes. Other anode jacking systems with individual screw jack devices incorporate clutches with interlocking teeth or jaws mounted on the output shafts of worm reduction gear boxes. When the clutches are disengaged, the anodes tend to descend from their own weight unless brakes are provided; and in the event of drive failure it is usually not feasible to move the anodes at all. The elimination or reduction of these problems would contribute advantageously to desired convenience, simplicity and economy in such operations as the electrolytic production of aluminum metal in multi-anode cells.

SUMMARY OF THE INVENTION

The present invention broadly contemplates the provision of an anode positioning system for an electrolytic cell having multiple suspended anodes, comprising a plurality of screw jacks each adapted to raise and lower one anode, a corresponding plurality of reduction gear means with outputs respectively connected to the screw jacks for individually driving the jacks, means including a motor for bidirectionally driving the plurality of reduction gear means, and means for transmitting drive from the driving means to the plurality of reduction gear means. As a particular feature of the invention, the drive-transmitting means includes a corresponding plurality of slipping frictional clutches respectively interposed between the driving means and the plurality of reduction gear means such that each of the gear means has an individual frictional clutch associated therewith. The frictional clutches are individually engageable and disengageable; preferably, each clutch is adjustable to vary the maximum torque it transmits.

In this combination of elements, the disposition of the clutches on the input side (i.e. connected to the input shafts) of the reduction gear means enables use of significantly smaller and less costly clutches than are required when the clutches are located on the output shafts of reduction gear boxes in anode positioning devices, because a much lower torque capacity is required for a clutch on the input shaft than for a clutch on the output shaft, and clutch size and cost are related to torque capacity. This disposition of the clutches, in particular, enables use of slipping frictional clutches, which slip rather than transmit torque whenever the torque developed exceeds a predetermined limit; in the case of clutches mounted on the output shafts of reduction gear boxes in anode positioning devices, the high torques involved have generally necessitated use of positively engaged clutches.

The provision of slipping frictional clutches rather than positively engaged clutches, in the system of the invention, in turn affords important advantages. As stated, slipping frictional clutches transmit torque only up to some predetermined or presettable limit; once the torque developed exceeds that limit, the clutches slip rather than transmit the excessive torque. Hence, excessive jacking forces can be prevented from being developed in the individual anode-lifting jacks because the clutches can be selected or adjusted to slip before damage can occur. Stalling of the driving motor, and consequent danger of burnout of the motor or components thereof, can be avoided because all the clutches associated with the individual anode-lifting jacks will slip before stalling torque is developed by the motor. In addition, each jack can travel to its limits and jam mechanically without causing buildup of destructive torque or other damaging forces, again because the frictional clutch associated with each jack will slip when the jack jams at its limits; upon reversing the drive motor, any jammed jack or jacks will become unjammed without requiring any attention or adjustment. These considerations enable use of a main drive motor of high horsepower to drive a single anode jack requiring a fraction of one horsepower with no risk of mechanical damage.

More generally, the provision of slipping frictional clutches enables safe use of a common drive for all the jacks of the system. This common drive system can be used to operate a single jack, by disengaging the clutches associated with the other jacks of the system, or to operate a limited number of the jacks, or to operate all the jacks; when employed to operate a plurality of jacks, the common drive moves all the anodes connected to those jacks in unison, i.e. at identical speeds with identical displacements from their respective starting points.

Additional advantages also follow from the provision of the clutches on the input shafts of the reduction gear means. When a clutch is disengaged, the internal friction of the reduction gear means effectively locks the associated jack to prevent the jack from free wheeling and allowing the anode to descend because of its own weight; thus no braking device is needed to prevent undesired anode descent when clutches are disengaged. Moreover, in the present system, with a clutch disengaged, it is possible to raise or lower the associated anode manually by turning the input shaft of its reduction gear means either directly by hand, or with a crank, or with appropriate auxiliary portable equipment. This ability to move the anodes manually, not generally afforded by anode-positioning devices having clutches on the output shafts of gear reduction boxes, is important during anode changes when a high speed motor, which is part of external anode changing equipment, would engage a nut on the free end of the worm reduction gear box input shaft to rapidly raise an old anode (for which purpose the clutch at the other end of the input shaft must be disengaged) in preparation for anode removal, and rapidly lower the new anode to its working position before disengaging the nut (and re-engaging the clutch on the input shaft for normal anode jack operation). This feature is also important and useful in the event of drive failure or if special attention and close monitoring of anode movement are required in particular circumstances.

As an additional feature of the invention, the drive-transmitting means of the present system can be arranged to be selectively operable to raise some anodes and lower other anodes, for the purpose of agitating the cell electrolyte, i.e. to "pump" the cell and thereby (in the case of alumina reduction cells) to quench anode effects. As is already known to those skilled in the art, when a number of anodes are raised in a cell, and an equal number of anodes are lowered at the same time, at the same speed, and with the same magnitude of vertical movement, the electrolytic cell bath is effectively agitated without being significantly changed in level, provided that the total area (in plan view) of the raised anodes is the same as the total area of lowered anodes.

To this end, the transmitting means of the system can include means, interposed between the driving means and the slipping frictional clutches, and selectively operable in either of two conditions, for imparting drive to at least two of the clutches in the same direction when operated in one of the aforesaid conditions and in respectively opposite directions when operated in the other of the aforesaid conditions. Thus, the last-mentioned selectively operable means can be arranged to impart drive to a first plurality (e.g. one half) of the clutches and a second plurality (e.g. the other half) of the clutches in the same direction or in respectively opposite directions. For example, with an alumina reduction cell of the type having a substantial plurality of anodes arranged in two rows, the present system may be arranged to enable the anodes of both rows to move either simultaneously in the same direction or simultaneously in respectively opposite directions; for this purpose, the selectively operable means may include two parallel shafts respectively driving the two rows of anodes, one of the shafts being driven directly by the driving means and the second shaft being connected to the first by means for selectively transmitting drive to the second shaft in either of two directions relative to the direction of rotation of the first shaft. In alternative embodiments of the invention, the anodes of both rows may be driven by a single shaft, or the two shafts of the aforementioned selectively operable means may be disposed in tandem (i.e. coaxially) so that each drives some anodes of both rows, and again connected by means for selectively transmitting drive from a first shaft (which is driven directly by the driving means) to the second in either of two directions relative to the direction of rotation of the first shaft, thereby to enable groups of anodes adjacent opposite ends of the cell to move either simultaneously in the same direction or simultaneously in respectively opposite directions.

Further features and advantages of the invention will be apparent from the detailed description hereinbelow set forth, together with the accompanying drawings.

BRIEF DESCRIPTION OF THE DRAWINGS

FIG. 1 is a simplified, schematic, fragmentary plan view (with support structure omitted) of an anode-positioning system embodying the present invention in a particular form, arranged for use in an electrolytic reduction cell for the production of aluminum metal;

FIG. 2 is a side elevational view taken as along the line 2—2 of FIG. 1;

FIG. 6 is an enlarged, detailed plan view of the clutch and reduction gear assembly, with associated elements, for one jack screw in the system of FIG. 3;

FIG. 7 is an enlarged fragmentary plan view of a portion of the system of FIG. 3;

DETAILED DESCRIPTION

Figure 3:
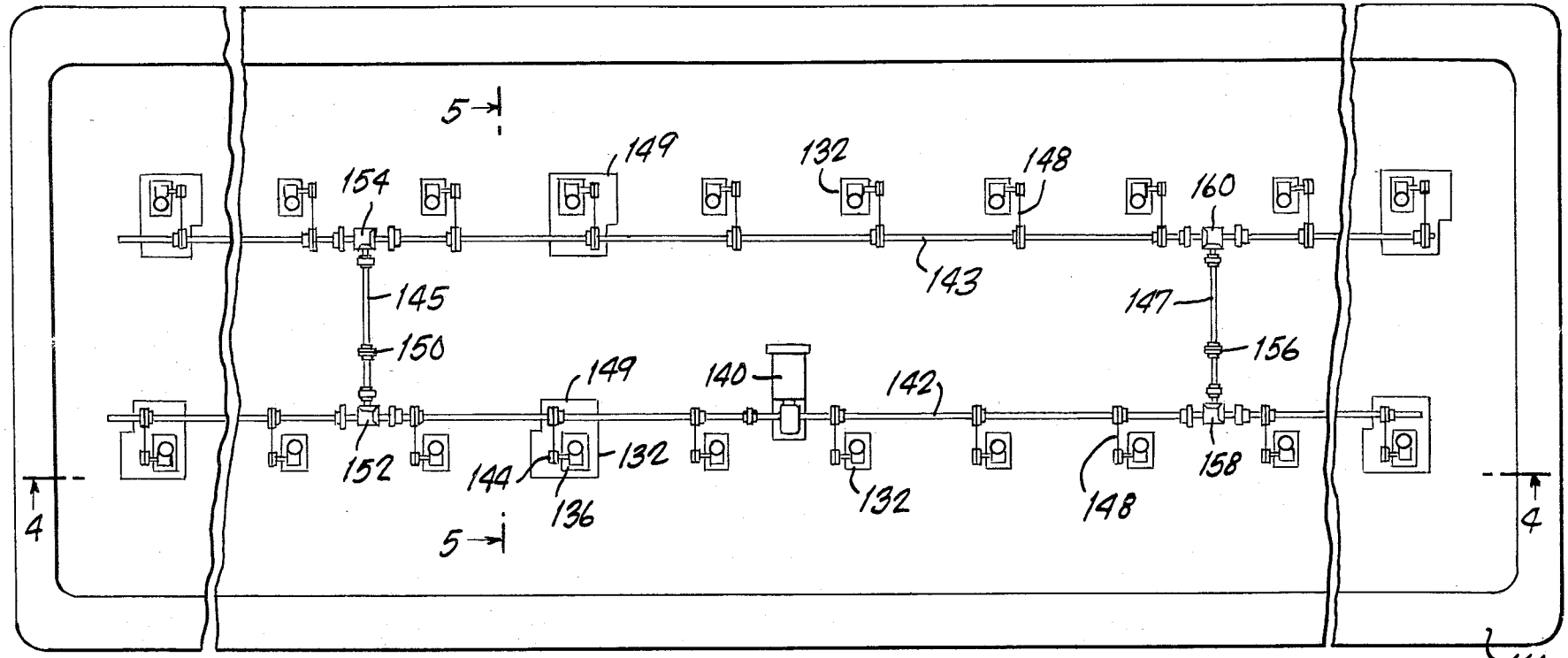
FIG. 3 is a plan view of an embodiment of the anode positioning system of the invention.
Figure 4:
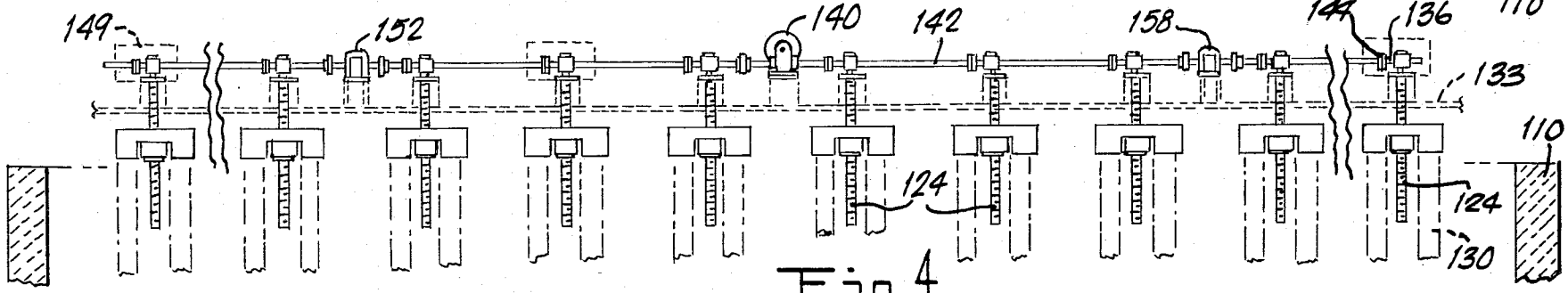
FIG. 4 is a side elevational view of the system of FIG. 3, taken along the line 4—4 of FIG. 3.
Figure 5:
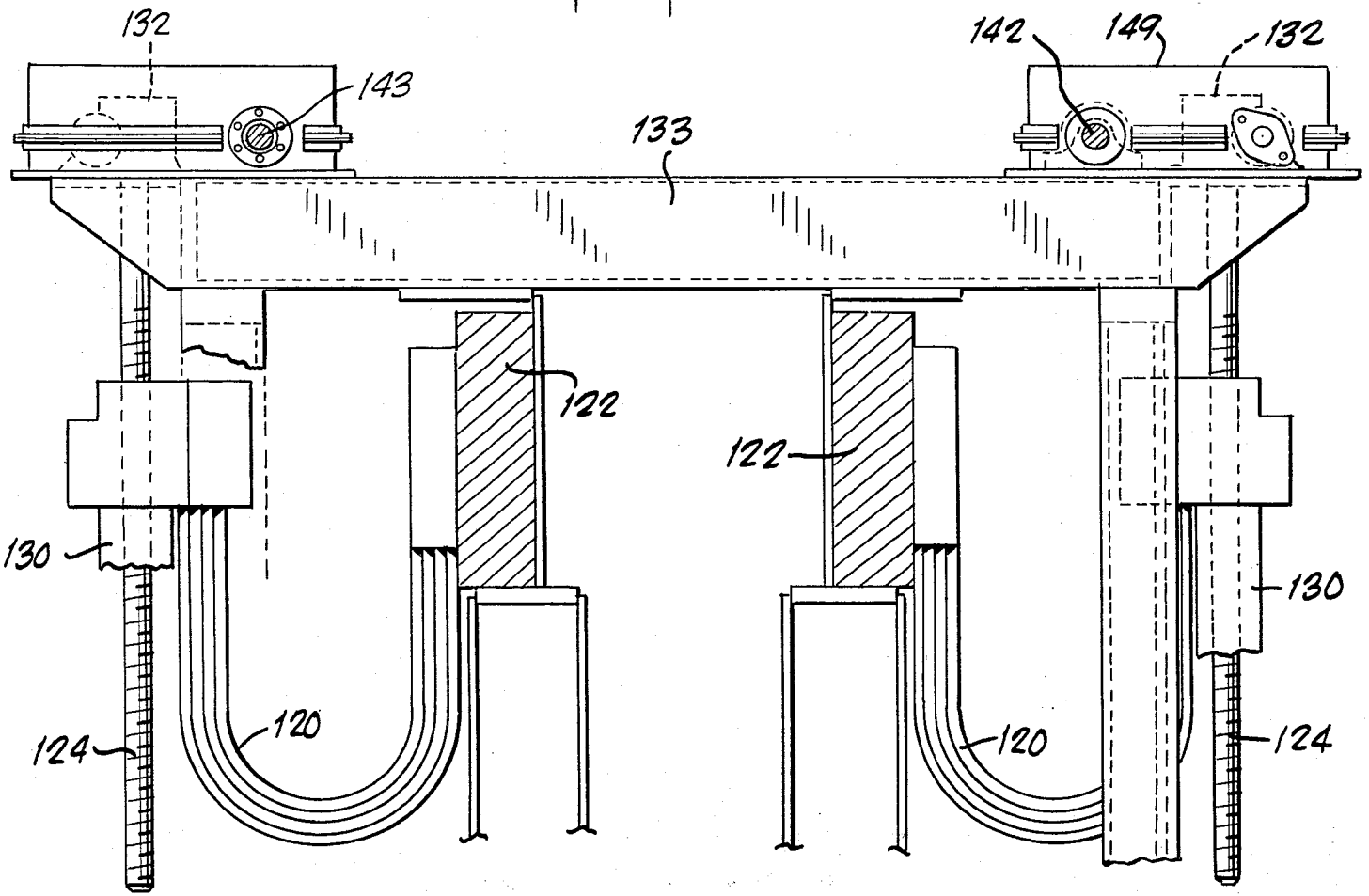
FIG. 5 is a cross-sectional elevational view of the system of FIG. 3, taken along the line 5—5 of FIG. 3.

In FIGS. 1 and 2, the invention is shown as embodied in a schematically illustrated system for raising and lowering multiple anodes in a typical, generally conventional cell for the electrolytic reduction of alumina to produce aluminum metal. The cell contains, within a confining wall structure 10, a body of molten salt electrolyte 12 (e.g. comprising cryolite) in which is dissolved the alumina to be reduced. A plurality of prebaked, block-shaped carbon anodes 14 are suspended in the electrolyte, in such positions that their downwardly facing surfaces are spaced above a layer 16 of molten aluminum metal which collects at the bottom of the cell, in contact with a carbon lining layer 18. The anodes are connected by flexible conductors 20 to an anode bus 22, and the carbon lining 18 of the cell has an external electrical connection (not shown) to enable the molten metal layer 16 to serve as the cathode of the cell.

In the operation of the cell, direct electric current passed through the molten salt electrolyte 12 between the anodes 14 and the metal layer 16 effects reduction of the alumina dissolved in the electrolyte, producing aluminum metal which accumulates in the molten metal layer or pool 16, and liberating oxygen at the anodes. From time to time, product metal is withdrawn from the pool 16, and fresh alumina is added to the electrolyte 12, which is usually covered with a crust (not shown). Carbon of the anodes 14 is progressively consumed by reaction with the oxygen liberated at the anodes.

The anodes 14 are shown as arranged in a row; for simplicity, only a single row of anodes is shown in FIGS. 1 and 2, but it will be understood that there are commonly two parallel rows of such anodes in an alumina reduction cell. Also for simplicity, all supporting structure both for the cell and for the hereinbelow-described system of the invention is omitted from the showing of FIGS. 1 and 2.

For various purposes, it is necessary to raise and lower the anodes 14 individually and/or collectively during the operation of the cell. For example, to maintain the anode-cathode distance within the relatively narrow limits required for satisfactory cell efficiency, the anodes must be moved up or down together in correspondence with changes in the level of the interface between the molten metal pool 16 and the electrolyte 12; such changes in level may be caused by progressive accumulation of produced metal in the pool 16, or by extraction of metal from the pool. Again, when an individual anode block has been substantially consumed by reaction with oxygen, the remnant of the block must be raised out of the cell and replaced. The present invention, in its embodiment now to be described, provides a system for effecting individual and collective vertical movement of the anodes for these and other purposes. It will be understood that the length of the flexible conductors 20 is sufficient to accommodate the desired range of vertical movement of the anodes 14.

The system of the invention, in the form schematically shown in FIGS. 1 and 2, includes a plurality of screw jacks 24 corresponding in number to the anodes 14 and respectively mounted directly above the anodes. Each screw jack includes an axially vertical screw 26, supported at a fixed elevation for rotation in either direction about its vertical axis, and a nut 28 threaded on the screw. One of the anodes 14 is suspended from the nut 28 by members 30 secured to the nut and to the subjacent anode; electrical connection between the anode and its associated conductor 20 is represented as made through one of these members 30, it being understood that the nut 28 is either electrically isolated from the anode and conductor or arranged to be at the same electrical potential so that electrical current will not flow through the nut, jacking screw and worm reduction gear box. In common screw jacks heretofore used in conventional anode-lifting devices, each jack 24 is so arranged that rotation of the screw 26 causes the nut 28 to move upwardly or downwardly (depending on the direction of screw rotation) thereby raising or lowering the anode 14 carried by the jack, e.g. between the solid-line position and the broken-line position 14' shown on the left-hand side of FIG. 2. As is also conventional, stops (not shown) may be provided to engage and thereby arrest the anode-supporting members 30 at positions corresponding to preselected limits of anode travel; such arrest of the anode at these limits of travel is herein termed jamming.

For each screw jack 24, there is provided a separate worm reduction gear assembly 32, comprising a driving worm 34 having an input shaft 36 and a driven or output gear 38 which meshes with the worm 34 and is fixedly connected to the upper end of the associated jack screw 26 so that the latter screw is driven by and rotates with the gear 38. Typically, each reduction gear assembly may have, for example, a 25:1 reduction ratio. Each gear assembly is supported by suitable structure (not shown) at a fixed elevation above the cell.

Also mounted above the cell (again on structure not shown in FIGS. 1 and 2) is a motor 40 having an output or drive shaft 42 extending above and parallel to the row of anodes 14, for bidirectionally driving all the gear assemblies 32 and thereby bidirectionally operating all the jacks 24. Mounted on the input shaft 36 of each gear assembly 32 is a slipping frictional clutch 44 through which drive is transmitted to the gear assembly from the shaft 42, a separate clutch being thus provided for each gear assembly. These clutches, as hereinafter further explained, may themselves be conventional in structure and operation and are adapted to transmit torque but to slip when the torque exceeds a predetermined or preset limit, thereby to prevent development of excessive torque such as could damage components of the system. In the illustrated system, drive is transmitted from the shaft 42 to the input members of the clutches 44 by individual sprocket and chain mechanisms 48.

Each of the clutches 44 is individually engageable and disengageable to connect or disconnect its associated gear assembly and screw jack from the system drive. It is currently preferred to keep all the clutches normally engaged so that all the anodes are normally linked mechanically to the drive. Also preferably, the clutches 44 are of a type wherein the limit of torque (above which the clutch will slip) is adjustably settable over a substantial range; such clutches are well known and currently commercially available.

The operation of the system of FIGS. 1 and 2 may now be readily understood. With all the clutches 44 engaged, the array of anodes 14 in the cell can be raised or lowered in unison by operating the motor 40 to drive the gear assemblies 32 in the appropriate (anode-raising or -lowering) direction. All the anodes are then displaced together with the same velocity and same extent of displacement. When the desired extent of anode movement has been achieved, the motor is stopped and the anodes halt. If, during such movement, the anodes (or any of them) have jammed, or if there has been any potentially excessive torque development in the system for any other reason, the clutch or clutches 44 involved simply slip, at their preset or predetermined torque limit, thereby preventing development of destructive torque such as could burn out the motor or damage other system components.

If it is desired to move only a single anode (for example, to raise a largely consumed anode entirely out of the bath for replacement) or to move only some of the anodes, the clutches 44 associated with the other anodes are first disengaged, and the motor 40 is then operated in the appropriate direction for moving the selected anode or anodes in the desired vertical direction. Again, motor operation continues only until the anode reaches its selected new level.

Alternatively, to move a single anode manually or with an external motor (for example during high speed anode changes or in the event of drive failure or when special handling of the anode is necessary), the clutch 44 associated with that anode is disengaged and the input shaft 36 of the gear assembly 32 for that anode is rotated manually, or with the aid of some suitable tool.

The embodiment of the invention illustrated in FIGS. 3–7 is arranged for use with an alumina reduction cell represented by cell wall 110 of elongated rectangular configuration (as seen in plan view), having a multiplicity of carbon anodes (not shown) disposed in two parallel rows extending lengthwise of the cell. This system includes an individual jack screw 124 for each anode and an individual worm reduction gear box 132 for each jack. The worm reduction gear boxes are supported above the cell on a framework or superstructure 133. The screw of each jack 124 is connected to and depends from the output of its associated gear box 132, and each anode is suspended by members 130 from the nut of its associated jack. As will be understood, the general arrangement of worm reduction boxes, jacks, and anodes in the system of FIGS. 3–7 is essentially the same as in the system schematically shown in FIGS. 1 and 2; thus, each reduction gear box 132 drives the jack 124 connected to its output so as to raise or lower the anode suspended from that jack. A flexible conductor 120 (FIG. 5) connects each anode to the anode bus 122 and is of sufficient length to permit a desired range of anode movement.

All the reduction gear boxes, and thus all the jacks, are driven by a bidirectional electric motor 140 supported on the superstructure 133 and having an output shaft 142 (which is directly driven by the motor) disposed above and extending parallel to one of the two rows of anodes. The shaft 142 is journalled along its length in suitable bearings 135 also supported in the superstructure 133.

A second shaft 143, also journalled in bearings (not shown) supported on the superstructure 133, extends above and parallel to the second row of anodes in the cell, being thus also parallel to the shaft 142. Transverse shafts 145 and 147 interconnect shafts 142 and 143, in a manner hereinafter further described, for transmitting drive from the shaft 142 (which is itself driven by the motor 140) to the shaft 143.

Each of the gear boxes 132 is provided with a slipping frictional clutch 144 (of a type also hereinafter further described) having its output member connected to input shaft 136 of the gear box and supported by the superstructure 133. The clutches 144 associated with the anodes of the row beneath shaft 142 are all driven by shaft 142, through sprocket and chain mechanisms 148 transmitting drive from shaft 142 to the input members of the clutches. The clutches 144 associated with the anodes of the row beneath shaft 143 are driven in like manner by the shaft 143 through sprocket and chain mechanisms 148 transmitting drive to their input members from the latter shaft. Thus, again as in the case of the system of FIGS. 1 and 2, drive is transmitted from the motor 140 to all the gear boxes 132 through individual slipping frictional clutches 144 respectively connected to the input shafts of the gear boxes. Each gear box 132 together with its associated clutch 144 and sprocket and chain mechanism 148 is enclosed within a housing 149 supported on the super-structure 133, only a few of such housings being shown in the drawings, for the sake of simplicity of illustration; the shafts 142 and 143 extend through these housings.

In the embodiment of FIGS. 3–7, each of the slipping frictional clutches is a pneumatically operated cone clutch of a currently commercially available type, having the air cylinder built into the clutch. The structure and operation of such clutches are well known and accordingly need not be described in detail. Stated generally, the clutch is arranged to be disengaged by an internal spring and engaged with compressed air, the air to and from each clutch being controlled by a pneumatic three-way normally open poppet valve, single solenoid operated with spring return, the clutch being engaged by air pressure when the solenoid is unenergized and becoming disengaged when the air is cut off by energization of the valve solenoid. The maximum allowable torque on the clutches is set by adjusting an air pressure regulator mounted in the clutch air supply line. With the described clutch, a setting of 28 p.s.i. is believed to provide sufficient torque in the clutch to produce a jacking force of 7,000 lbs.

Alternative types of friction clutches could be employed in place of the described pneumatic clutches 144. For example, magnetic or solenoid-operated friction clutches could be used, or jaw clutches in series with wrench-adjusted torque limiter clutches or hydraulically operated clutches. However, the commercially available pneumatic clutches described above are at present preferred as being advantageously compact and inexpensive, easy to operate and to adjust for torque level, and capable of tolerating the conditions to which they are exposed in use on an alumina reduction cell, viz. alumina dust, high temperatures, and saturated magnetic fields. The solenoid valves which operate the pneumatic clutches can conveniently be mounted in clusters on the cell superstructure, in such location and alignment that they will operate satisfactorily without magnetic shielding or problems resulting from excessive temperatures, all as will be readily apparent to those skilled in the art.

The system of FIGS. 3–7 can be operated in the manner already described with reference to FIGS. 1 and 2, to move all the anodes simultaneously in the same direction, or to move one or only some of the anodes. In addition, the system of FIGS. 3–7 is selectively operable to raise the anodes of one row while simultaneously lowering the anodes of the other row in such a way that the anodes all move exactly equal amounts from the equilibrium position at equal speeds in equal times because all of the anodes are mechanically linked together and driven by the one bidirectional motor 140, thereby to "pump" the cell, i.e. to agitate the bath as may be desired to quench anode effects. The bath level does not significantly change under these conditions so long as the number of anodes raised equals the number of anodes lowered and given that the areas of the two sets of anodes in plan view are the same.

Mechanically, this is accomplished by the arrangement and interconnection of the two shafts 142 and 143, each of which is mechanically connected (by chain drives 148) to the clutches 144 of all the anode jacks 124 associated with one row of the anodes. The shaft 142 is driven by the bidirectional motor 140 directly while the shaft 143 is driven by the first shaft 142 through a selected one of the two transverse shafts 145 and 147.

The transverse shaft 145 actually comprises two shaft portions **145*a* and 145*b* connected endwise through a clutch 150 intermediate the shafts 142 and 143. At its end remote from the clutch 150, shaft portion 145*a* is driven by the shaft 142** through a right-angle (bevel)

gear box 152; at the opposite extremity of shaft 145, the shaft portion 145*b* drives shaft 143 through another right-angle gear box 154. In like manner, the transverse shaft 147 comprises shaft portions 147*a* and 147*b* connected endwise through a clutch 156, with shaft portion 147*a* driven by shaft 142 through a right-angle gear box 158 and shaft portion 147*b* driving shaft 143 through a further right-angle gear box 160. The shafts 142, 145, 147 and 143 may incorporate flexible couplings 162 adjacent the right-angle gear boxes at the locations shown in FIG. 7. Each of the clutches 150 and 156 is individually engageable and disengageable; these clutches may, for example, be slipping frictional clutches (e.g. pneumatic friction clutches), but positively engaged clutches with interlocking teeth or jaws would be preferable for the transverse shafts where no slipping is required or desirable once the clutch has been engaged.

The transverse shaft 145 has the gears in the right angle gear boxes 152 and 154 arranged so that the two shafts 142 and 143 turn an equal number of revolutions when the clutch 150 is engaged but turn in opposite directions. In the system of FIGS. 3–7, equal but opposite rotation of the shafts 142 and 143 results in all of the anodes either rising together or descending together. When the clutch 150 is disengaged and the clutch 156 in the transverse shaft 147 is engaged, the arrangement of gears in the right angle gear boxes 158 and 160 is such that both shafts 142 and 143 will turn an equal number of revolutions in the same direction, resulting in anodes of one row in the cell being raised while anodes in the other row are lowered. It is not necessary to raise all the anodes of one row while lowering all the anodes of the other row but it is advisable to raise as many anodes as are lowered; this is done in the present system by engaging only the clutches on the individual jacking systems of the anodes selected to be moved in the "pumping" mode. After the cell is "pumped," the motor is reversed to bring all of the anodes back to their original equilibrium or starting positions.

Figure 8:
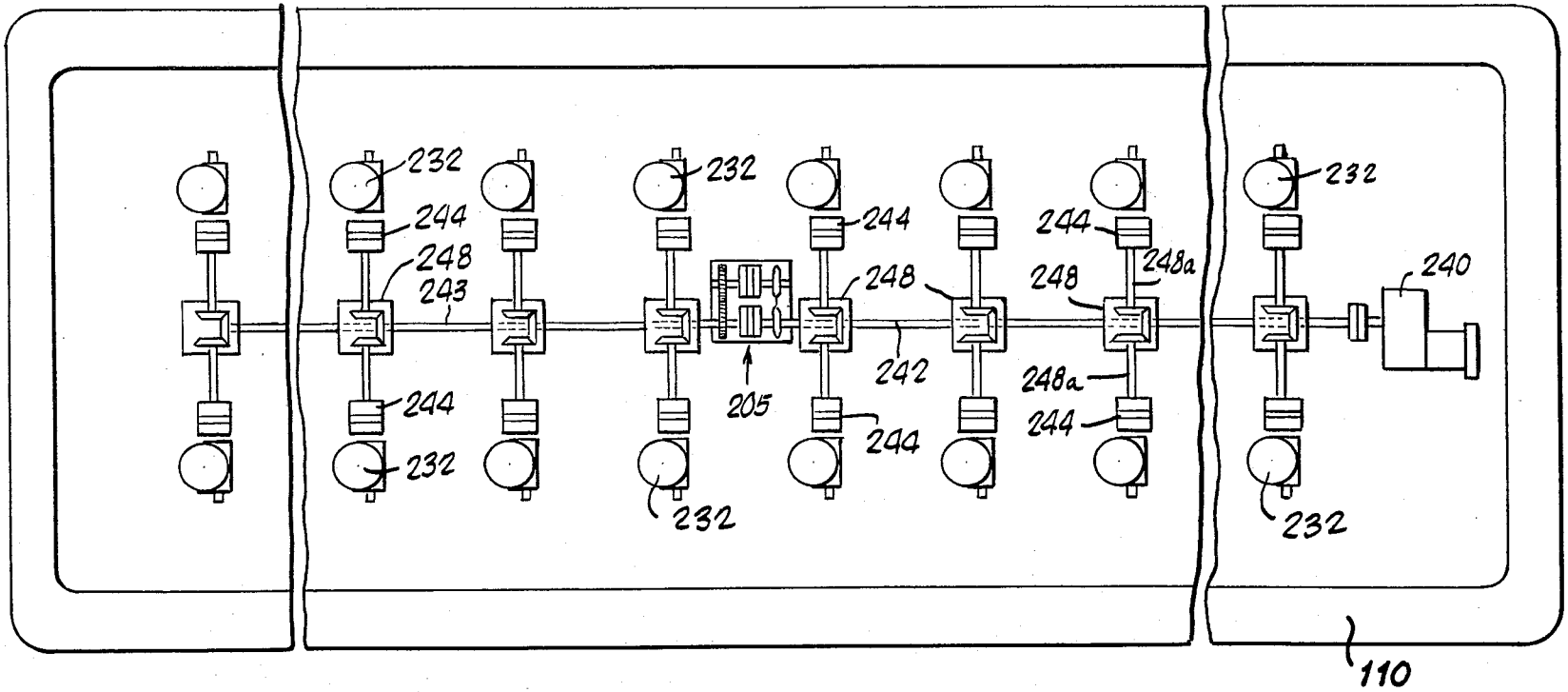
FIG. 8 is a plan view, similar to FIG. 3, of another embodiment of the invention.

FIG. 8 illustrates an alternative embodiment of the invention, again arranged for use with the above-described alumina reduction cell represented by cell wall 110 of elongated rectangular configuration, having multiple carbon anodes (not shown) disposed in two parallel rows extending lengthwise of the cell. As in the case of the system of FIGS. 3–7, the system of FIG. 8 includes an individual jack screw (not shown) for each anode and an individual worm reduction gear box 232 for each jack, these worm reduction gear boxes being supported on the cell superstructure (also not shown) directly above the anodes with which they are respectively associated. The arrangement of worm reduction gear boxes, screw jacks, and anodes may be essentially identical to that described above with reference to FIGS. 3–7. Thus, each worm reduction gear box 232 drives the jack screw connected to its output so as to raise or lower the anode suspended therefrom.

All the reduction gear boxes 232 are driven by a bidirectional motor 240 having an output shaft 242 (directly driven by the motor) extending above and lengthwise of the cell intermediate the two rows of anodes. As shown, the motor 240 is disposed at one end of the cell, and is connected to one end of the shaft 242, which extends halfway along the length of the cell. A second shaft 243, disposed in tandem coaxial relation to shaft 242, extends from the extremity of that shaft to the other end of the cell, i.e. again above the cell and intermediate the two rows of anodes; above the middle of the cell, the facing ends of shafts 242 and 243 are interconnected by a clutch assembly 245 (hereinafter further described) for transmitting drive from the first shaft 242 to the second shaft 243. In some respects (i.e. in some modes of operation), the two shafts 242 and 243 can be considered as a single shaft transmitting drive from the motor 240 to the worm reduction gear boxes of all the anodes of both rows. It will be understood that both shafts 242 and 243 are journaled along their lengths in suitable bearings (not shown) supported by the cell superstructure, which also supports the clutch assembly 245.

Each of the gear boxes 232 is provided with a slipping frictional clutch 244 (for example, of the type described above with reference to FIGS. 3–7) having its output member connected to the input shaft of the gear box and supported by the cell superstructure. The clutches 244 associated with both rows of anodes in that half of the cell over which the shaft 242 extends are driven by the shaft 242 through gear assemblies 248 which transmit drive to the input members of the clutches 244, while the clutches 244 associated with the anodes of both rows in the other half of the cell are similarly driven by the shaft 243 through identical gear boxes 248 transmitting drive to their input members.

Figure 9:
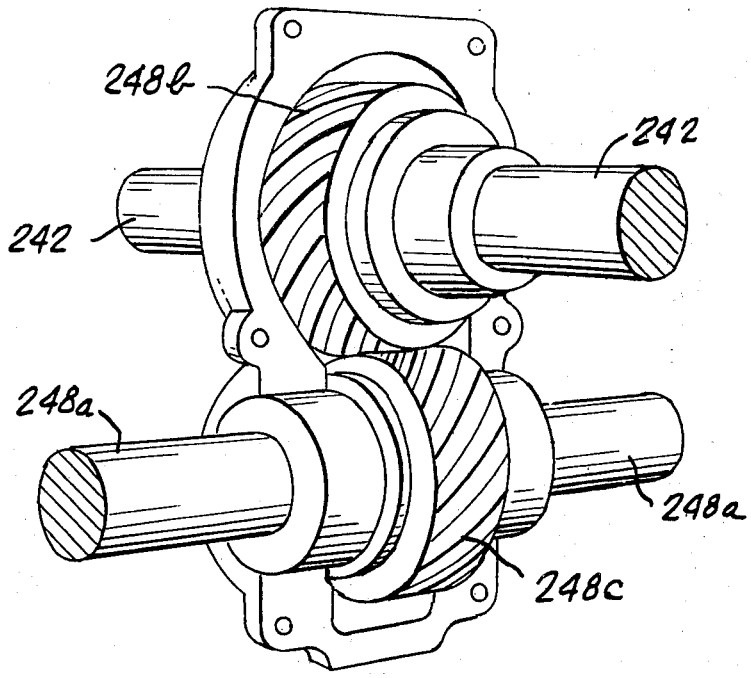
FIG. 9 is an enlarged fragmentary perspective view of an alternative gear arrangement for transmitting drive to two anodes respectively disposed on opposite sides of the cell, in the system of FIG. 8.

Any convenient type of right-angle gear box can be employed to provide the gear boxes 248 in the system. As shown, the anodes of the two rows in the cell are paired, i.e. disposed directly opposite each other; hence from each gear box 248 a pair of opposed drive-transmitting shafts 248*a* extend, at right angles to the shaft 242 or 243, toward the sides of the cell to impart drive, respectively, to the input members of two clutches 244. In FIG. 8, each gear box 248 is shown as comprising an assembly of bevel gears so arranged that the two shafts 248*a* projecting from a given gear box 248 are driven in respectively opposite directions; in this case, the worms of the reduction gear boxes 232 associated with one row of anodes have right-handed threads while the worms of the reduction gear boxes associated with the other rows of anodes have left-handed threads, so that the anodes of both rows will move in the same direction notwithstanding the opposite directions of rotation of the shafts 248*a* on the two sides of the cell. The gear boxes 248 may alternatively be worm reduction gear boxes wherein the worm shaft is in line with and part of the shaft 242 or 243; or they may be gear boxes each having two 45° helical gears 248*b* and 248*c* which mesh at 90° to each other, as shown in FIG. 9. In the latter case, each gear 248*b* is carried on the shaft 242 or 243, while each meshing gear 248*c* drives both shafts 248*a* in the same direction, and accordingly, the worms of the reduction gear boxes 232 of both anode rows will have the same thread orientation.

Figure 10:
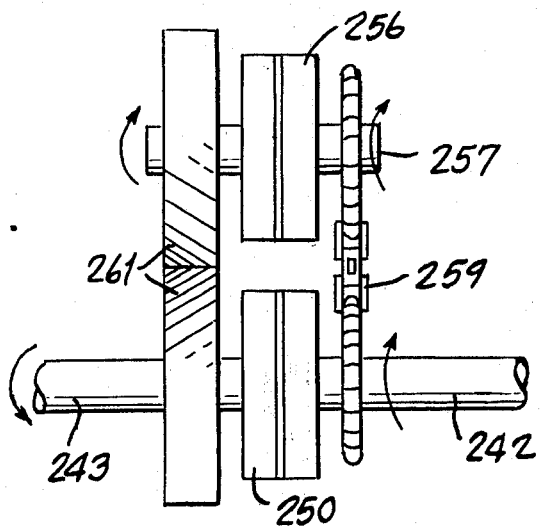
FIGS. 10 and 11 are enlarged fragmentary, schematic plan views showing two alternative forms of means for transmitting drive from the first shaft to the second in the system of FIG. 8.

The clutch assembly 245, which transmits drive from the motor-driven shaft 242 to the second shaft 243, is selectively operable to drive the latter shaft in either of two directions relative to the direction of rotation of shaft 242. As shown in FIG. 10, this assembly may include a pair of individually disengageable clutches 250 and 256, with clutch 250 positioned to interconnect shafts 242 and 243 directly, while clutch 256 is arranged to interconnect two portions of an auxiliary shaft 257 driven on its input side by shaft 242 through a chain and sprocket 259. The output side of shaft 257 drives shaft 243 through pinions 261. When clutch 250 is engaged and clutch 256 is disengaged, the shaft 242 drives shaft 243 directly through clutch 250, and both shafts rotate in the same direction; however, when clutch 250 is disengaged and clutch 256 is engaged, the shaft 242 drives shaft 243 through shaft 257, clutch 256, and pinions 261 which reverse the direction of rotation so that shaft 243 is driven in a direction opposite to that of shaft 242.

Figure 11:
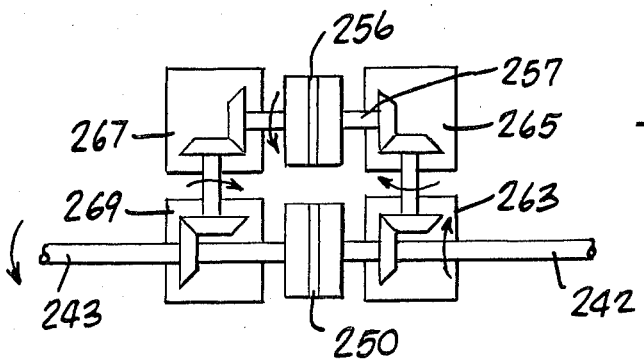

An alternative arrangement for the assembly 245 is shown in FIG. 11. This arrangement again includes the clutch 250 directly interconnecting shafts 242 and 243, and clutch 256 interconnecting input and output portions of auxiliary shaft 257, but in this case, drive is transmitted to the input portion of shaft 257 from shaft 242 through a pair of bevel gear boxes 263 and 265, and drive is transmitted from the output portion of shaft 257 to shaft 243 through a further pair of bevel gear boxes 267 and 269. Again the arrangement is such that when clutch 250 is engaged and clutch 256 is disengaged, shafts 242 and 243 both rotate in the same direction, but when clutch 256 is engaged and clutch 250 is disengaged, the shafts rotate in opposite directions.

So long as the clutch assembly 245 is operated to drive the shaft 243 in the same direction as shaft 242, rotation of the shaft 242 by the motor 240 will either raise all the anodes of both rows or lower all the anodes of both rows, assuming that the slipping frictional clutches 244 of all the anodes are engaged. Of course, if any of the clutches 244 are disengaged, the anodes associated with those disengaged clutches will remain stationary when the shafts 242 and 243 rotate.

Several modes of pumping operation are possible with the system of FIG. 8. If the gear assembly 245 is operated to drive the shaft 243 in a direction opposite to the direction of rotation of shaft 242, and all the clutches 244 are engaged, then drive imparted by the motor 240 will simultaneously move the anodes driven by shaft 242 and those driven by shaft 243 in respectively opposite directions; i.e. the anodes of both rows at one end of the cell will move up while the anodes of both rows at the other end of the cell are moving down by an equal amount and at an equal velocity.

In a modification of this mode of pumping, found advantageous in some cases, the frictional clutches associated with the anodes of one row driven by the shaft 243 are disengaged, as are the frictional clutches associated with the other row of anodes driven by shaft 242, so that oppositely directed drive of the shafts 242 and 243 moves the anodes on one side at one end of the cell up and simultaneously moves the anodes on the other side at the other end of the cell down by an equal amount and at an equal velocity. In still a third pumping mode, with the shafts 242 and 243 connected to be driven in the same direction, the clutches 244 of one row of anodes are disengaged along the length of the cell while the shafts 242 and 243 are rotated to move the second row of anodes in a given direction; then the clutches 244 of the second row are disengaged, the clutches of the first row are re-engaged, and the shafts 242 and 243 are driven to move the anodes of the first row in an opposite direction, providing a sequential rather than simultaneous pumping action that (as is sometimes desirable) causes a fluctuation of cell bath level. This latter mode of pumping can also be performed in a system wherein the shafts 242 and 243 are integral, i.e. constituting a single shaft and omitting the clutch assembly 245. In a system having two shafts for driving different sets or rows of anodes, as described and shown above with reference to FIGS. 3 and 8, it would also be possible to drive the two shafts by means of separate motors, but such an arrangement would not provide the assured uniformity of velocity and extend of displacement of all anodes achieved by drive of the anodes with a single motor.

It is to be understood that the invention is not limited to the features and embodiments hereinabove specifically set forth but may be carried out in other ways without departure from its spirit.

I claim:

1. An anode positioning system for an electrolytic cell having multiple suspended anodes, comprising:
   (a) a plurality of screw jacks each adapted to raise and lower one anode;
   (b) a corresponding plurality of reduction gear means with outputs respectively connected to said screw jacks for individually driving said jacks;
   (c) means including a motor for bidirectionally driving said plurality of reduction gear means; and
   (d) means for transmitting drive from said driving means to said plurality of reduction gear means including a corresponding plurality of slipping frictional clutches respectively interposed between said driving means and said plurality of reduction gear means such that each of said gear means has an individual frictional clutch associated therewith.

2. A system as defined in claim 1, wherein each of said frictional clutches is individually engageable and disengageable.

3. A system as defined in claim 1 or 2, wherein each of said frictional clutches is adjustable to vary the maximum torque transmitted by the frictional clutch.

4. A system as defined in claim 3, wherein each of said frictional clutches is a pneumatic clutch.

5. A system as defined in claim 1 or 2, wherein said transmitting means includes means, interposed between said driving means and said slipping frictional clutches, and selectively operable in either of two conditions, for imparting drive to at least two of said clutches in the same direction when operated in one of said conditions and imparting drive to said two clutches in respectively opposite directions when operated in the other of said conditions.

6. A system as defined in claim 5, wherein said selectively operable means comprises
   (i) a first shaft, driven by said driving means and connected to one of said two frictional clutches to impart drive thereto in a predetermined direction relative to the direction of rotation of the first shaft;
   (ii) a second shaft, connected to the other of said two frictional clutches to impart drive thereto in a predetermined direction relative to the direction of rotation of the second shaft; and
   (iii) means, including a pair of individually disengageable clutches, interconnecting said first and second shafts for selectively transmitting drive from said first shaft to said second shaft to drive said second shaft in the direction of rotation of the first shaft, and in the direction opposite thereto.

7. A system as defined in claim 6, including a first plurality of said frictional clutches connected to be driven by said first shaft, and a second plurality of said frictional clutches connected to be driven by said second shaft, and a number of screw jacks equal to the number of said frictional clutches and respectively associated therewith.

8. An anode positioning system for an electrolytic cell having multiple suspended anodes, comprising:

(a) a plurality of screw jacks, each adapted to raise and lower one anode, and arranged in two rows each containing more than one jack;
(b) a corresponding plurality of worm reduction gear boxes with outputs respectively connected to said screw jacks for individually driving said jacks, each of said gear boxes having an input shaft;
(c) means including a motor for bidirectionally driving said plurality of gear boxes; and
(d) means for transmitting drive from said driving means to said plurality of gear boxes, including
(i) a corresponding plurality of slipping frictional clutches respectively interposed between said driving means and said input shafts such that each of said input shafts has an individual frictional clutch associated therewith, each of said frictional clutches being individually engageable and disengageable;
(ii) a first shaft, driven by said motor, and connected to the frictional clutches associated with the jacks of one of said rows to impart drive thereto in a predetermined direction relative to the direction of rotation of the first shaft,
(iii) a second shaft, connected to the frictional clutches associated with the jacks of the other of said rows to impart drive thereto in a predetermined direction relative to the direction of rotation of the second shaft, and
(iv) means for transmitting drive from the first shaft to the second shaft, selectively operable to drive the second shaft in either of two directions relative to the direction of rotation of the first shaft.

9. A system as defined in claim 8, wherein said means for transmitting drive from the first shaft to the second shaft comprises a pair of transverse shafts each interconnecting said first and second shafts for transmitting drive from said first shaft to said second shaft to drive said second shaft in the direction of rotation of the first shaft, and in the direction opposite thereto, respectively; and a pair of individually disengageable clutches respectively mounted on said transverse shafts for selectively controlling transmission of drive by said transverse shafts such that at any given time, drive is transmitted through only a selected one of said transverse shafts.

10. An anode positioning system for an electrolytic cell having multiple suspended anodes, comprising:
(a) a plurality of screw jacks, each adapted to raise and lower one anode, and arranged in two rows each containing more than one jack;
(b) a corresponding plurality of worm reduction gear boxes with output respectively connected to said screw jacks for individually driving said jacks, each of said gear boxes having an input shaft,
(c) means including a motor for bidirectionally driving said plurality of gear boxes; and
(d) means for transmitting drive from said driving means to said plurality of gear boxes, including
(i) a corresponding plurality of slipping frictional clutches respectively interposed between said driving means and said input shafts such that each of said input shafts has an individual frictional clutch associated therewith, each of said frictional clutches being individually engageable and disengageable;
(ii) a first shaft, driven by said motor, and connected to the frictional clutches associated with the jacks of a first portion of both of said rows to impart drive thereto in a predetermined direction relative to the direction of rotation of the first shaft,
(iii) a second shaft, disposed in tandem with said first shaft, and connected to the frictional clutches associated with the jacks of the remainder of both of said rows to impart drive thereto in a predetermined direction relative to the direction of rotation of the second shaft, and
(iv) means for transmitting drive from the first shaft to the second shaft, selectively operable to drive the second shaft in either of two directions relative to the direction of rotation of the first shaft.

11. A system as defined in claim 10, wherein said means for transmitting drive from the first shaft to the second shaft includes an auxiliary shaft interconnecting said first and second shafts for transmitting drive from the first shaft to the second shaft to drive the second shaft in a direction opposite to the direction of said first shaft, and a pair of individually disengageable clutches respectively mounted between said first and second shafts and on said auxiliary shaft for selectively controlling transmission of drive such that drive can be transmitted from said first shaft to said second shaft either directly or through said auxiliary shaft.

12. An anode positioning system for an electrolytic cell having multiple suspended anodes, comprising:
(a) a plurality of screw jacks, each adapted to raise and lower one anode, and arranged in two rows each containing more than one jack;
(b) a corresponding plurality of worm reduction gear boxes with outputs respectively connected to said screw jacks for individually driving said jacks, each of said gear boxes having an input shaft;
(c) means including a motor for bidirectionally driving said plurality of gear boxes; and
(d) means for transmitting drive from said driving means to said plurality of gear boxes, including
(i) a corresponding plurality of slipping frictional clutches respectively interposed between said driving means and said input shafts such that each of said input shafts has an individual frictional clutch associated therewith, each of said frictional clutches being individually engageable and disengageable; and
(ii) a shaft, driven by said motor, and connected to the frictional clutches associated with the jacks of both of said rows to impart drive thereto in a predetermined direction relative to the direction of rotation of said last-mentioned shaft.

* * * * *